United States Patent [19]

Asami et al.

[11] Patent Number: 4,711,617

[45] Date of Patent: Dec. 8, 1987

[54] ROTARY COMPRESSOR

[75] Inventors: Kazutomo Asami; Fumiaki Sano; Fumio Wada; Koji Ishijima, all of Shizuoka, Japan

[73] Assignee: Mitsubishi Denki Kabushiki Kaisha, Tokyo, Japan

[21] Appl. No.: 38,166

[22] Filed: Apr. 14, 1987

[51] Int. Cl.[4] ..... F04B 49/00

[52] U.S. Cl. ..... 417/295; 417/310

[58] Field of Search ..... 417/295, 310, 302

[56] References Cited

U.S. PATENT DOCUMENTS

| | | | |
|---|---|---|---|
| 3,224,662 | 12/1965 | Oldberg | 417/310 |
| 4,237,926 | 12/1980 | Walker | 417/295 |
| 4,522,038 | 5/1983 | Ozu | 62/228.5 |
| 4,556,863 | 1/1986 | Goto et al. | 417/310 |

FOREIGN PATENT DOCUMENTS

| | | | |
|---|---|---|---|
| 58-87988 | 9/1977 | Japan . | |
| 113282 | 6/1984 | Japan | 417/295 |

*Primary Examiner*—William L. Freeh

*Attorney, Agent, or Firm*—Armstrong, Nikaido, Marmelstein & Kubovcik

[57] ABSTRACT

In a rotary compressor for compressing a refrigerant gas by a compressor element adapted to be rotated by an electric motor, the improvement comprises a cylindrical member provided inside or outside the closed container and communicated with the first intake passage and with the first discharge passage; a second intake passage communicated with the cylindrical member and with the compressor element; a second discharge passage communicated with the cylindrical member and within the closed container; a first communication passage for communicating the second intake passage with one end of the cylindrical member; a second communication passage for communicating the closed container with the other end of the cylindrical member; and a valve member provided in the cylindrical member; and a spring which urges the end of the valve near the first communication passage; the valve member being moved to a first position to communicate the first intake pasage with the second intake passage and also communicate the first discharge passage with the second discharge passage when one end of the valve member is urged by a discharge pressure of the refrigerant gas, through the second communication passage while the valve member being moved to a second position to make the first intake passage out of communication with the second intake passage and also make the first discharge passage out of communication with the second discharge passage when the other end of the valve member is urged by a reverse currernt pressure of the refrigerant gas from the first communication passage and a spring pressure.

10 Claims, 10 Drawing Figures

ROTARY COMPRESSOR

BACKGROUND OF THE INVENTION

The present invention relates to a compressor for compressing a refrigerant gas by a compressor element adapted to be rotated by an electric motor.

FIG. 8 shows a schematic illustration of a conventional refrigerating cycle as disclosed in Japanese Patent Laid-Open Publication No. 58-211587, for example. The refrigerating cycle includes a rotary compressor 1, a condensor 2, a solenoid valve 3, a capillary tube 4, an evaporator 5 and a check valve 6.

When the compressor 1 starts operating, a refrigerant gas compressed is fed to the condeser 2 in a direction shown by an arrow, and is condensed by the condenser 2. Then, the refrigerant gas condensed is fed to the evaporator 5, and is evaporated by the evaporator 5 is conduct a refrigerating operation. The evaporated gas is then returned to the compressor 1. When the compressor 1 is stopped, the solenoid valve 3 is operated to cut a part of a high-pressure circuit of the refrigerating cycle, and the check valve 6 is operated to cut a part of a low-pressure circuit. Under the stopped condition of the compressor 1, a large amount of high-temperature and high-pressure gas in a closed container flows through the condenser 2, the capillary tube 4 and the evaporator 5, and also flows through sealing portions of parts of the compressor element in the closed container into a cylinder, an intake pipe and the evaporator 5 (so that pressure and temperature in the circuit may be balanced), which will cause an increase in heat load of the refrigerating cycle to reduce an efficiency of the refrigerating cycle. The above-mentioned cutting of the circuit by the solenoid valve 3 and the check valve 6 is intended to suppress the reduction in the efficiency of the refrigerating cycle.

FIG. 9 shows another example of the conventional refrigerating cycle carrying out the same operation as the above shown in FIG. 8, utilizing a change in pressure differential across the check valve 6. The refrigerating cycle includes a pressure differential valve 7 adapted to be operated by pressure signals from signal tubes 8 and 9 connected to both sides of the check valve 6, which valve 7 usually incorporates a diaphragm. The pressure differential valve 7 detects a high-pressure signal (discharge side) and a low-pressure signal (intake side). After stoppage of the compressor 1, a low pressure (pressure between the compressor 1 and the check valve 6) is increased to almost balance with a high pressure on one side of the diaphragm. Such a displacement of the diaphragm is utilized to operate valve members provided in the high-pressure and low-pressure circuits.

FIG. 10 shows a further example of the conventional refrigerating cycle having th same function as above, using an integral type pressure differential valve 10 including a check valve assembled with a pressure differential valve.

In the above-mentioned various refrigerating cycles, the solenoid valve 3, the pressure differential valve 7 or the integral type pressure differential valve 10 is used for the purpose of preventing a reverse current of the refrigerant gas upon stoppage of the compressor 1. In the casing of the solenoid valve 3, the solenoid valve itself consumes a power to reduce the efficiency of the refrigerating cycle. In the case of the pressure differential valve 7 or the integral type pressure differential valve 10, a signal piping and an operational structure are complicated to cause a defective operation. Further, the number of welding portions is increased to cause leakage of the refrigerant gas, thus reducing the reliability. Additionally, costs for manufacturing and assembling these control valves are increased.

SUMMARY OF THE INVENTION

It is an object of the present invention to provide a rotary compressor including an inexpensive valve unit having a simple structure and a high reliability, which may improve an operating efficiency of a refrigerating cycle.

It is another object of the present invention to provide a rotary compressor including a valve unit which may be improved in operation more reliably.

According to one aspect of the present invention, in a rotary compressor including a closed container, an electric motor accommodated in the closed container, a compressor element accommodated in the closed container and adapted to be rotated by the electric motor, a first intake passage connected to the closed container for receiving a refrigerant gas, and a first discharge passage connected to the closed container for discharging the refrigerant gas after compressed by the compressor element from the closed container to a refrigerating cycle; the improvement comprises a cylindrical member provided inside or outside the closed container and communicated with the first intake passage and with the first discharge passage; a second intake passage communicated with the cylindrical member and with the commpressor element; a second discharge passage communicated with the cylindrical member and within the closed container; a first communication passage for communicating the second intake passage with one end of the cylindrical member; a second communication passage for communicating said closed container with the other end of said cylindrical member; a valve member provided in the cylindrical member; and a spring which urges the end of said valve near said first communication passage; the valve member being moved to a first position to communicate the first intake passage with the second intake passage and also communicate the first discharge passage with the second discharge passage when one end of the valve member is urged by a discharge pressure of the refrigerant gas through said second communication passage, while the valve member being moved to a second position to make the first intake passage out of communication with the second intake passage and also make the first discharge passage out of communication with the second discharge passage when the other end of the valve member is urged by a reverse current pressure of the refrigerant gas from the first communication passage and a spring pressure.

During operation of the compressor, the valve member in the cylindrical member is urged by the discharge pressure to communicate the first and second intake passages with each other and also communicate the first and second discharge passages with each other. In contrast, upon stoppage of the compressor, the refrigerant gas is reversely flown into the cylindrical member to increase pressure at one end portion of the valve member. The increased pressure and the spring force act to move the valve member to the position where the communication between the first and second intake passage are blocked, and the communication between the first and second discharge passages are also blocked.

According to another aspect of the present invention, in a rotary compressor including a closed container, an electric motor accommodated in the closed container, a compressor element accommodated in the closed container and adapted to be rotated by the electric motor, a first intake passage connected to the closed container for receiving a refrigerant gas, and a first discharge passage connected to the closed container for discharging the refrigerant gas after compressed by the compressor element from the closed container to a refrigerating cycle; the improvement comprises a cylindrical member provided inside or outside the closed container and communicated with the first intake passage and with the first discharge passage; a second intake passage communicated with the cylindrical member and with the compressor element; a second discharge passage communicated with the cylindrical member and within the closed container; a first communication passage for communicating the second intake passage with one end of the cylindrical member; a second communication passage for communicating said closed container with the other end of said cylindrical member; a valve member provided in the cylindrical member; and a spring which urges the end of said valve near said first communication passage; the valve member being moved to a first position to communicate the first intake passage with the second intake passage and also communicate the first discharge passage with the second discharge passage when one end of the valve member is urged by a discharge pressure of the refrigerant gas, while the valve member being moved to a second position to make the first intake passage out of communication with the second intake passage and also make the first discharge passage out of communication with the second discharge passage when the other end of the valve member is urged by a reverse current pressure of the refrigerant gas from the communication passage and a spring pressure; and a reverse current blocking means provided in the second intake passage for blocking a reverse current of the refrigerant gas.

With this arrangement, as a reverse current resistance in the second intake passage upon stoppage of the compressor is increased, the pressure at the other end portion of the valve member is rapidly increased to thereby make the movement of the valve member more quick.

Other objects and features of the invention will be more fully understood from the following detailed description and appended claims when taken with the accompanying drawings.

DETAILED DESCRIPTION OF THE PREFERRED EMBODIMENTS

Figure 1:
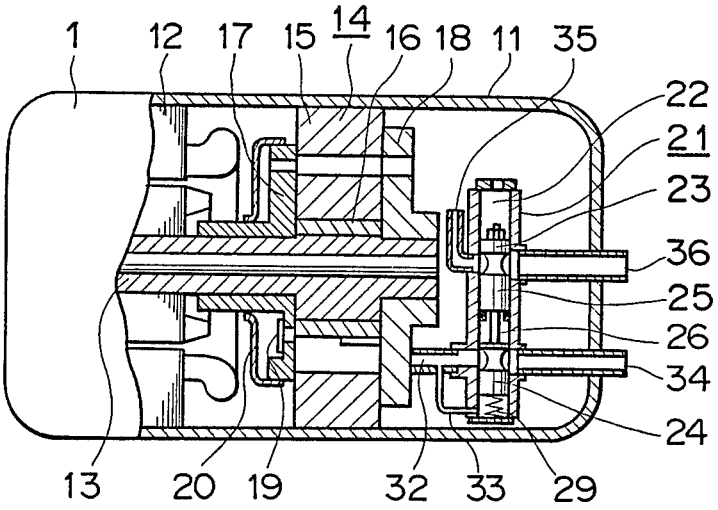
FIG. 1 is a partially broken side view of the rotary compressor of a preferred embodiment according to the present invention.

FIGS. 1 to 4 show a preferred embodiment of the present invention, in which reference numerals 1, 2, 4 and 5 designate the same parts as of the afore-mentioned prior art devices.

Figure 8:
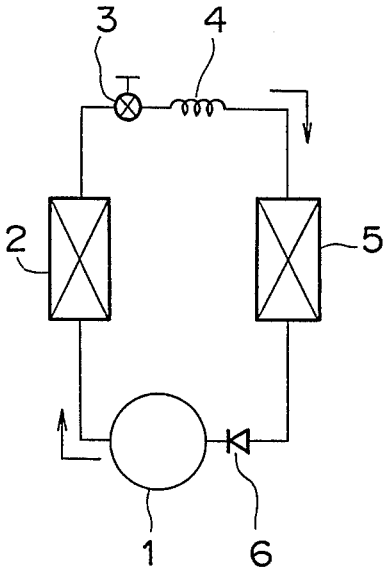
FIGS. 8 to 10 are schematic illustrations of a refrigerating cycle in the prior art.
Figure 9:
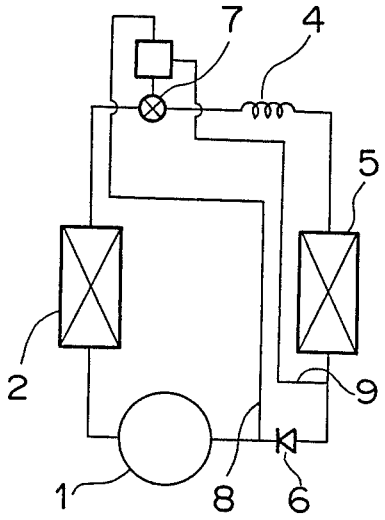
Figure 10:
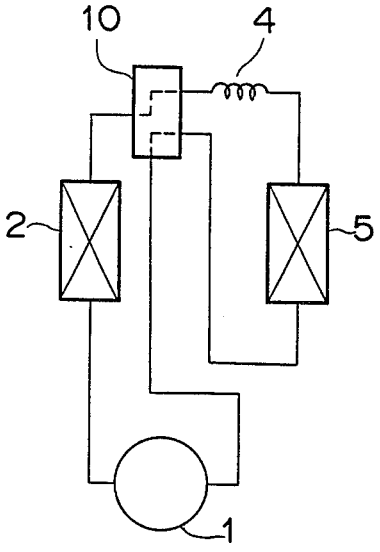

Refrring to the drawings, a compressor 1 includes a closed container 11, an electric motor 12 accommodated in the closed container 11, a crank shaft 13 adapted to be driven by the electric motor 12, and a compressor element 14 comprising a cylinder 15 and a piston 16. The cylinder 15 is fixed to the closed container 11, and the piston 16 is engaged in an eccentric portion of the crank shaft 13, so as to be eccentrically rotated in the cylinder 15. The cylinder 15 is provided with a vane (not shown) passing therethrough, which vane is biased at its one end by a pusher spring (not shown), and is contacted at the other end with the outer circumference of the piston 16, so that the vane may be reciprocated by the rotation of the piston 16. Bearings 17 and 18 are fixed to the compressor element 14 to support the crank shaft 13. The bearing 17 is provided with a discharge valve 19, which is covered with a discharge muffler 20. A valve unit 21 is arranged between the compressor element 14 and an inner wall of the closed container 11. The valve unit 21 includes a cylindrical member 22 forming a body thereof, which cylindrical member 22 includes two through-holes **22*a* and 22*b* forming a part of an intake passage and a discharge passage, respectively. Spaces 22*c* and 22*d* are defined on an intake valve side and a discharge valve side at end portions of the cylindrical member 22. Reference numeral 23 designates a valve member slidably mounted in the cylindrical member 22, which valve member 23 comprises an intake valve 24 and a discharge valve 25. The intake valve 24 comprises an hourglass-shaped communicating portion 24*a* and a columnar closing portion 24*b*, while the discharge valve 25 similarly comprises a communicating portion 25*a* and a closing portion 25*b*. The intake valve 24 and the discharge valve 25 are connected with each other by a connecting rod 26. An annular stopper 27 is fixed to an inner wall of the cylindrical member 22 to restrict a lower limit position of the discharge valve 25. A sealing member 28 such as a packing or an O-ring is fixed to an end surface of the stopper member 27 on the discharge valve 25 side. A pusher spring 29 is provided in the space 22*c* on the intake valve side to bias an end portion of the intake valve 24. A plug 30 is provided to close an end surface of the cylindrical member 22 on the intake valve side, and an apertured plug 31 is provided on the other end surface of the cylindrical member 22 on the discharge valve side. An intake passage 32 is provided to connect the intake side of the compressor element 14 with the through-hole 22*a* of the cylindrical member 22. A communication passage 33 is provided to communicate the intake passage 32 with the space 22*c* of the cylindrical member 22. An intake pipe 34 forming a part of the intake passage is connected with the through-hole 22*a*, and is also connected through the closed container 11 to an evaporator 5. A discharge passage 35 is connected with the through-hole 22*b* and is communicated to the closed container 11. A discharge pipe 36 forming a part of the discharge passage is connected with the through-hole 22*b*, and is also connected through the closed container 11 to a condenser 2. The compressor 1 of the preferred embodiment does not include the solenoid valve 3, the pressure differential valve 7 or the integral type pressure differential valve 10 as shown in FIGS. 8 to 10**.

Figure 2:
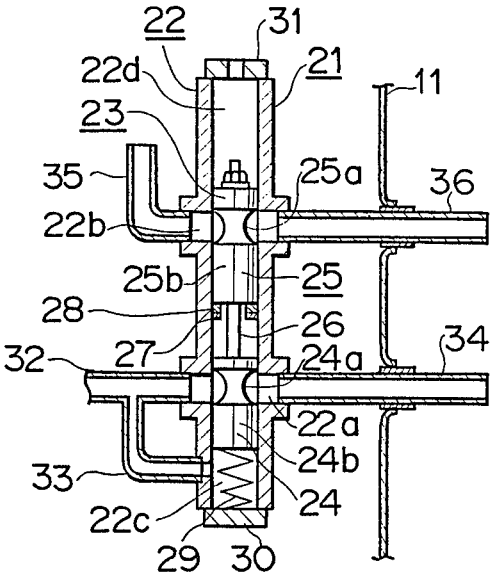
FIGS. 2 and 3 are vertical sectional views of the valve unit shown in FIG. 1.

In operation, when the compressor 1 is being operated, the valve member 23 is in a position where the end surface of the discharge valve 25 abuts against the sealing member 28 as shown in FIG. 2, because a force $P_2$ due to pressure in the space 22*d* of the cylindrical member 22 is greater than the sum of a force $P_1$ due to pressure in the space 22*c* of the cylindrical member 22 and a force $P_s$ of the pusher spring 29 to resultantly urge the valve member 23 against the sealing member 27. At this time, the communicating portions 24*a* and 25*a* of the valve member 23 are positioned in coincidence with the through-holes 22*a* and 22*b*, respectively, to thereby communicate the intake pipe 34 with the intake passage 32 and also communicate the discharge passage 35 with the discharge pipe 36. Further, high and low pressures are blocked by the abutment of the discharge valve 25 against the sealing member 28.

Figure 3:
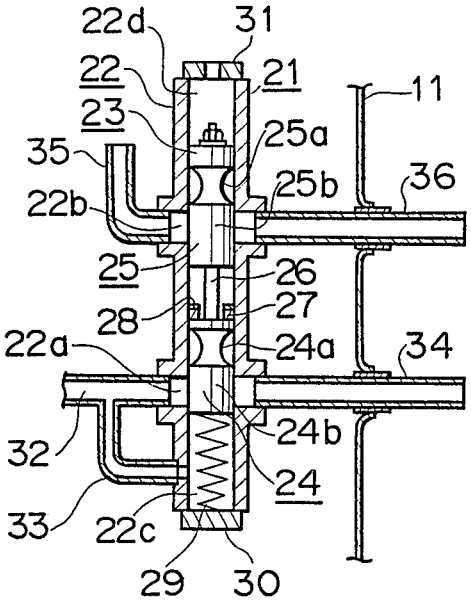

When the compressor 1 is stopped, the refrigerant gas having high pressure and high temperature in the closed container 11 is reversely flown from an air-tight portion of the parts of the compressor element 14, for example, a gap of a vane guiding through-hole of the cylinder 15 through the interior of the cylinder 15 to the intake passage 32. As the pressure is transmitted through the communication passage 33 to the space 22*c*, the inner pressure of the space 22*c* is increased. As a result, the sum of a force $P_1$ due to the inner pressure of the space 22*c* and a force $P_s$ of the pusher spring 29 becomes greater than the force $P_2$ due to the pressure in the space 22*d*, thereby moving the valve member 23 to the discharge valve 25 until the upper end surface of the intake valve 24 comes into abutment against the stopper member 27 as shown in FIG. 3. At this time, the closing portions 24*b* and 25*b* of the valve member 23 are positioned in coincidence with the through-holes 22*a* and 22*b* to thereby make the intake pipe 34 out of communication with the intake passage 32 and also make the discharge passage 35 out of communication with the discharge pipe 36. Thus, a large amount of the refrigerant gas in the closed container 1 is suppressed from reversely flowing through the intake pipe 34 into the evaporator 5.

When the compressor 1 is started again, the piston 16 is rotated, and the pressure $P_1$ in the intake passage 32 to the compressor element 14 is lowered. As a result, the sum of the pressure $P_1$ and the force $P_s$ of the pusher spring 29 becomes smaller than the force $P_2$ due to the pressure in the closed container 11, and accordingly the valve member 23 is moved again to the intake valve 24 until the lower end of the discharge valve 25 abuts against the sealing member 27, thereby communicating the intake passage 32 with the intake pipe 34 and also communicating the discharge passage 35 with the discharge pipe 36.

Figure 7:
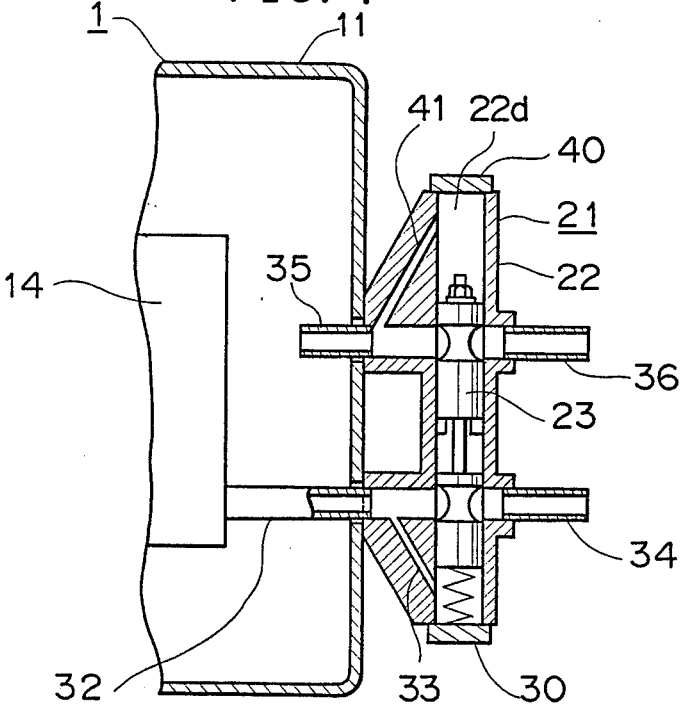
FIGS. 5 to 7 are vertical sectional views of the valve member of modified embodiments.
Figure 4:
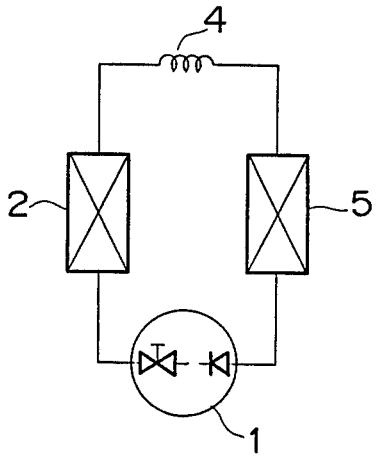
FIG. 4 is a schematic illustration of a refrigerating cycle according to the present invention.
Figure 5:
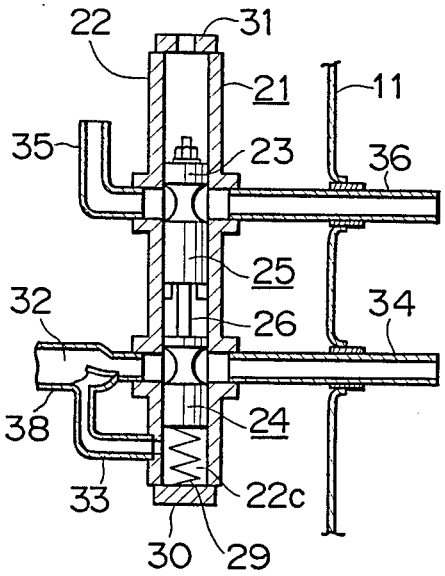
Figure 6:
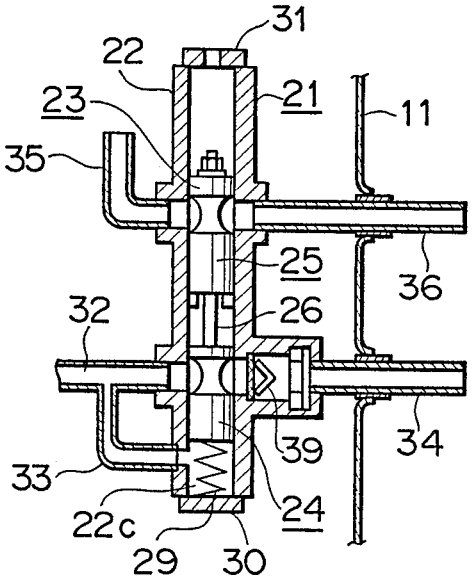

FIGS. 5 to 7 show some modified embodiments of the present invention. Referring to FIG. 5, a reverse current blocking member 38 such as a fluid diode is provided between the communication passage 33 and the intake valve 24 in the intake passage 32, so as to block a reverse current of the refrigerant gas.

With this arrangement, since a reverse current resistance in the intake passage 32 is increased, the pressure in the space 22*c* after stoppage of the compressor 1 is rapidly increased to thereby make the intake passage 32 out of communication with the intake pipe 34 in a short time after stoppage of the compressor 1. Thus, it is possible to obtain a more reliable valve control operation. As a result, it is possible to minimize a discharge amount of the refrigerant gas having high temperature and high pressure out of the closed container 1.

Referring to FIG. 6, the reverse current blocking member of a check valve 39 is provided between the intake valve 24 and the intake pipe 34. The operation is similar to that of the previous embodiment using the fluid diode 38 as shown in FIG. 5.

Referring to FIG. 7, the valve unit 21 is provided outisde the closed container 11 adjacent thereto. The upper end of the cylindrical member 22 is fully closed by a plug 40. The space 22*d* on the discharge valve side is communicated through a communication passage 41 to the discharge passage 35. The operation and the function is quite similar to that of the previous embodiment as shown in FIGS. 1 to 3.

As is described above, the valve unit 21 is provided as a part of the compressor 1 inside the closed container or outside thereof adjacent thereto. Accordingly, the number of welding parts of the compressor 1 on a user side may be widely reduced to thereby achieve a sufficient reliability and a low cost.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a rotary compressor including a closed container, an electric motor accommodated in said closed container, a compressor element accommodated in said closed container and adapted to be rotated by said electric motor, a first intake passage connected to said closed container for receiving a refrigerant gas, and a first discharge passage connected to said closed container for discharging said refrigerant gas after compressed by said compressor element from said closed container to a refrigerating cycle; the improvement comprising a cylindrical member provided inside said closed container and communicated with said first intake passage and with said first discharge passage; a second intake passage communicated with said cylindrical member and with said compressor element; a second discharge passage communicated with said cylindrical member and within said closed container; a first communication passage for communicating said second intake passage with one end of said cylindrical member; a second communication passage for communicating said closed container with the other end of said cylindrical member; a valve member provided in said cylindrical member; and a spring which urges the end of said valve near said first communication passage; said valve member being moved to a first position to communicate said first intake passage with said second intake passage and also communicate said first discharge passage with said second discharge passage when one end of said valve member is urged by a discharge pressure of said refrigerant gas through said second communication passage, while said valve member being moved to a second position to make said first intake passage out of communication with said second intake passage and also make said first discharge passage out of communication with said second discharge passage when the other end of said valve member is urged by a reverse current pressure of said refrigerant gas from said first communication passage and a spring pressure.

2. The rotary compressor as defined in claim 1, further comprising a reverse current blocking means provided in said second intake passage for blocking a reverse current of said refrigerant gas.

3. The rotary compressor as defined in claim 1, further comprising a reverse current blocking means provided in said first intake passage for blocking a reverse current of said refrigerant gas.

4. The rotary compressor as defined in claim 2, wherein said reverse current blocking means comprises a fluid diode.

5. The rotary compressor as defined in claim 3, wherein said reverse current blocking means comprises a check valve.

6. In a rotary compressor including a closed container, an electric motor accommodated in said closed container, a compressor element accommodated in said closed container and adapted to be rotated by said electric motor, a first intake passage connected to said closed container for receiving a refrigerant gas, and a first discharge passage connected to said closed container for discharging said refrigerant gas after compressed by said compressor element from said closed container to a refrigerating cycle; the improvement comprising a cylindrical member provided outside said closed container and communicated with said first intake passage and with said first discharge passage; a second intake passage communicated with said cylindrical member and with said compressor element; a second discharge passage communicated with said cylindrical member and within said closed container; a first communication passage for communicating said second intake passage with one end of said cylindrical member; a second communication passage for communicating said second discharge passage with the other end of said cylindrical member; a valve member provided in said cylindrical member; and a spring which urges the end of said valve near said first communication passage; said valve member being moved to a first position to communicate said first intake passage with said second intake passage and also communicate said first discharge passage with said second discharge passage when one end of said valve member is urged by a discharge pressure of said refrigerant gas, while said valve member being moved to a second position to make said first intake passage out of communication with said second intake passage and also make said first discharge passage out of communication with said second discharge passage when the other end of said valve member is urged by a reverse current pressure of said refrigerant gas from said communication passage and a spring pressure.

7. The rotary compressor as defined in claim 6, further comprising a reverse current blocking means provided in said second intake passage for blocking a reverse current of said refrigerant gas.

8. The rotary compressor as defined in claim 6, further comprising a reverse current blocking means provided in said first intake passage for blocking a reverse current of said refrigerant gas.

9. The rotary compressor as defined in claim 7, wherein said reverse current blocking means comprises a fluid diode.

10. The rotary compressor as defined in claim 8, wherein said reverse current blocking means comprises a check valve.

* * * * *